US007628706B2

(12) United States Patent
Xie

(10) Patent No.: US 7,628,706 B2
(45) Date of Patent: Dec. 8, 2009

(54) POOL CUE TIP CONDITIONING APPARATUS

(76) Inventor: WenKai W. X. Xie, 3355 Barr Rd., NW, Calgary, Alberta (CA) T2L 1M7

( * ) Notice: Subject to any disclaimer, the term of this patent is extended or adjusted under 35 U.S.C. 154(b) by 0 days.

(21) Appl. No.: 11/598,174

(22) Filed: Nov. 13, 2006

(65) Prior Publication Data

US 2008/0113595 A1 May 15, 2008

(51) Int. Cl.
*A63D 15/16* (2006.01)
*A63D 15/00* (2006.01)

(52) U.S. Cl. ..... 473/36; 473/35; 473/39; 30/494

(58) Field of Classification Search ..... 473/35–39; 224/183, 271, 918
See application file for complete search history.

(56) References Cited

U.S. PATENT DOCUMENTS 221,164 A * 11/1879 Fautz ..... 473/35
363,898 A * 5/1887 Labre ..... 473/36
965,444 A * 7/1910 Dahl ..... 473/36
2,628,096 A * 2/1953 Bell ..... 473/36
4,785,586 A * 11/1988 Kratfel ..... 451/552
5,046,728 A * 9/1991 Haddock ..... 473/36
5,104,122 A * 4/1992 Gossman ..... 473/1
6,520,863 B2 * 2/2003 Porper ..... 473/35

* cited by examiner

*Primary Examiner*—Mitra Aryanpour

(57) ABSTRACT

An apparatus for abrading and shaping a pool cue tip comprises: i) a block having an upper side portion having a concave contour therein said contour having an abrasive surface so that a pool cue tip can be abraded and shaped therewith; and, ii) a block holder adapted to closely surround a lower portion of the block. In a preferred aspect of this invention a side portion of the block opposite the side portion thereof having the concave indentation therein further comprises i) a circular void dimensioned to receive a chalk insert; ii) a replaceable chalk insert dimensioned to be closely received, and positioned in the circular void; and, iii) a removed semi-round upper portion in an upright side portion of the block holder to accommodate access to the chalk insert in the block thereunder and therein. In yet another aspect of this invention the apparatus further comprises a belt clip and a releasable attachment means, which includes a slot having a wider upper portion for releasably attaching the apparatus to the clip.

9 Claims, 1 Drawing Sheet

POOL CUE TIP CONDITIONING APPARATUS

FIELD OF THE INVENTION

This invention relates to pool cues used in billiards and snooker. More particularly this invention relates to a pool cue tip conditioning apparatus used to chalk, and abrasively roughen or shape cue tips. The apparatus is provided with an attractive carrying attachment which facilitates frequent access during a game.

BACKGROUND OF THE INVENTION

Pool halls frequently provide tables supplied with a piece of chalk. This chalk is applied to cue tips by players to reduce slippage of the cue tip on the cue ball. In many shots the cue ball is struck above or below center thereby producing a spin on the cue ball. This spin is used to position the cue ball for the next shot, after the target ball has been struck. After successive impacts with the cue ball, the tip of the cue, which is usually leather becomes relatively smooth and polished. It is then desirable to roughen the surface so that chalk will better adhere thereto. The cue tip may also become misshaped. When an upper or lower peripheral portion of the cue tip is used to strike the cue ball the upper or lower peripheral portion of the tip may become flattened. During use the particular peripheral or central portion thereof may even become depressed. The particular peripheral portion may additionally bulge radially outwards over and beyond the cue stick. When the cue ball is hit with a non-rounded cue tip the ball may be most impacted with other than the central portion of the cue tip. When the cue ball is struck laterally off center the cue ball then deviates laterally from its intended trajectory not striking the target ball as desired. It is then necessary to use an abrasive tool to reshape the cue tip.

When a piece chalk is supplied by the pool hall it is usually on a complimentary per table basis. It is not unusual for players to remove this chalk. And it is not unusual for no shared chalk to be available. Not only do discriminating players want a frequently chalked cue tip, but additionally they require a rough, well shaped, cue tip in order to make optimum shots. It would be unusual for a pool hall to provide an abrasive tool to roughen and shape a pool cue tip. One reason for this would be that their cue tips would need to be replaced more frequently. Another, probably better reason would be that these abrasive tools would be time consuming to monitor and prevent from disappearing. Discriminating players frequently bet at least the table rent on the outcome of the game. They want to have every advantage which is legal. What is needed is not only a conveniently carried piece of chalk, but additionally, an abrasive apparatus to ensure that their cue tips are continuously in optimal condition. If such an apparatus were provided with an attractive carrying attachment a player would find it convenient to have the apparatus when needed. The carrying attachment should also facilitated frequent removal and replacement during play so the player is able to maintain individual convenient hands free possession of the apparatus.

OBJECTS OF THE INVENTION

It is an object of this invention to disclose an apparatus for chalking, abrading and shaping a pool cue tip. It is an object of this invention to disclose an apparatus which is convenient to carry. It is yet a further object of this invention to disclose an apparatus having a carrying attachment which facilitates frequent removal and replacement during play so the player is able to maintain individual convenient hands free possession of the apparatus. It is a final object of this invention to disclose an apparatus which facilitates convenient replacement of chalk and/or the abrasive surface thereon.

One aspect of this invention provides for an apparatus for abrading and shaping a pool cue tip comprises: i) a block having an upper side portion having a concave contour therein said contour having an abrasive surface so that a pool cue tip can be abraded and shaped therewith; and, ii) a block holder adapted to closely surround a lower portion of the block.

In a preferred aspect of this invention a side portion of the block opposite the side portion thereof having the concave indentation therein further comprises i) a circular void dimensioned to receive a chalk insert; ii) a replaceable chalk insert dimensioned to be closely received, and positioned in the circular void; and, iii) a removed semi-round upper portion in an upright side portion of the block holder to accommodate access to the chalk insert in the block thereunder and therein.

In the most preferred embodiment of the invention the apparatus further comprises a belt clip and a releasable attachment means, which includes a slot having a wider upper portion for releasably attaching the apparatus to the clip.

In yet another aspect of the invention an apparatus to chalk, abrade and shape a pool tip cue, comprises: a block holder configured to receive the lower portion of a block of chalk of the type having a concave indentation in an upper side portion thereof; said block holder having an abrasive attachment adhered to one side portion thereof.

Various other objects, advantages and features of this invention will become apparent to those skilled in the art from the following description in conjunction with the accompanying drawings.

FIGURES OF THE INVENTION

Figure 1:
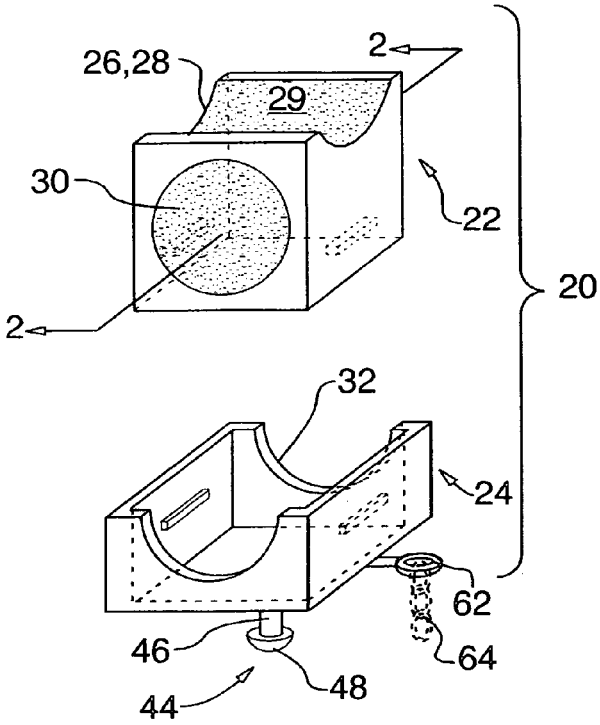
FIG. 1 is an exploded perspective view of an apparatus comprising a block and block holder for shaping abrading and shaping a pool cue tip.
Figure 3:
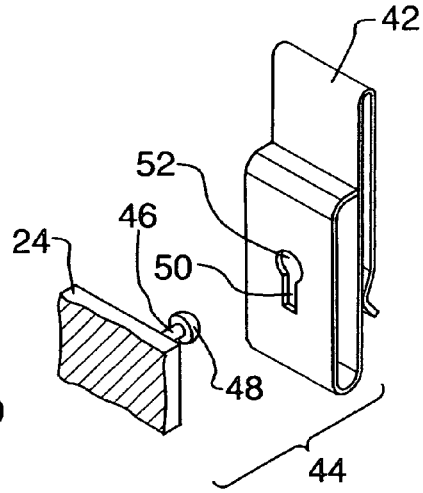
FIG. 3 is a perspective view of a belt clip and attachment peg used to releasably carry the apparatus shown in FIG. 1.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

DESCRIPTION OF THE INVENTION

Turning now to the drawings and more particularly to FIG. 1 we have an exploded perspective view of an apparatus 20 comprising a block 22 and block holder 24 for abrading and shaping a pool cue tip (not shown). Most generally, the apparatus 20 for abrading and shaping the pool cue tip (not shown) comprises: i) a block 22 having an upper side portion having a concave contour 26 therein said contour 26 including an abrasive surface 29 so that a pool cue tip (not shown) can be abraded and shaped therewith; and, ii) a block holder 24 adapted to closely surround a lower portion of the block 22.

In a preferred embodiment of the invention the concave contour 26 on the top side portion of the block 22 comprises a valley 28 contoured on a single axis, and wherein a side portion of the block adjacent to the top side portion further comprises a concave indentation 30 therein contoured on two axis. To accommodate access to the concave indentation 30 in the block 22 thereunder and therein, the block holder 24 has a semi-round portion 32 removed from an upright side portion thereof. In the most preferred embodiment of the invention the block 22 is formed continuously therethrough from an abrasive medium. It is alternatively contemplated that the block 22 might include an abrasive surface 29 made of expanded hardened metal.

Figure 2:
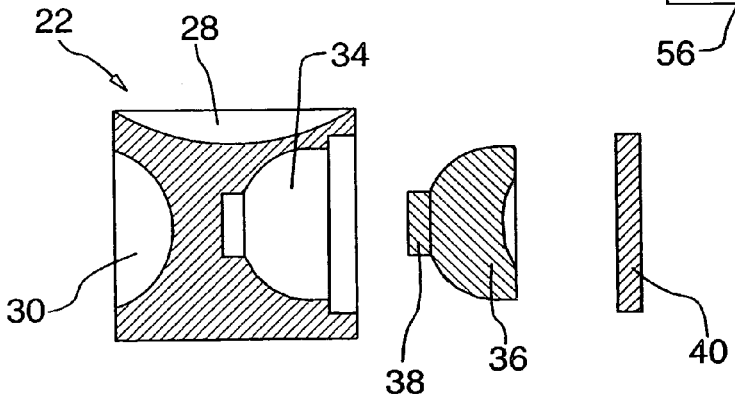
FIG. 2 is an exploded cross sectional view of the block shown in FIG. 1 further comprising a chalk insert for chalking a pool cue tip.

FIG. 2 is an exploded cross sectional view of the block 22 shown in FIG. 1 further comprising a chalk insert for chalking a pool cue tip (not shown). The apparatus 20 shown is similar to that described above. However to abrade, shape, and additionally chalk a cue tip (not shown), a side portion of the block 22 opposite the side portion thereof having the concave indentation 30 therein further comprises i) a circular void 34 dimensioned to closely receive a chalk insert 36; ii) a replaceable chalk insert 36 dimensioned to be closely received, and positioned in the circular void 34; and, iii) a removed semi-round upper portion in an upright side portion of the block holder 24 to accommodate access to the chalk insert 36 in the block 22 thereunder and therein. In the most preferred embodiment of the invention a chalk cover 40 is provided to cover the chalk insert 36 in the block 22 when the apparatus 20 is not in use. Most preferably the chalk insert 36 has an inner square portion 38 to ensure the chalk insert 36 does not rotate in the block 22 during use. The chalk insert 36 can be glued in the circular void 34.

In the most preferred embodiment of the invention a belt clip 42 is provided. Within this specification belt clip is used generically and defined to include any type of clip used to attach to clothing or a key ring. The belt clip 42 has a releasable attachment means 44 for releasably attaching the apparatus 20 to the clip 42. In the most preferred embodiment of the invention the releasable attachment means 44 comprises a peg 46 having an outer diameter, said peg 46 having one end attached to the chalk cover 24, and the other opposite end having a head 48 of an enlarged diameter; and wherein the an outside portion of the clip 42 comprises an elongate vertical slot 50 having sufficient width to receive the outside diameter of the peg 46, said vertical slot having a wider upper portion 52 having sufficient width to receive the enlarged diameter of the head 48. When the peg's head is 48 inserted through the wider upper portion 52 and then lowered in the slot 50 then the apparatus 20 is thereby releasably attached to the belt clip 42. The apparatus 20 may then be quickly and conveniently removed and replaced from the belt clip 42 for use during play.

Figure 4:
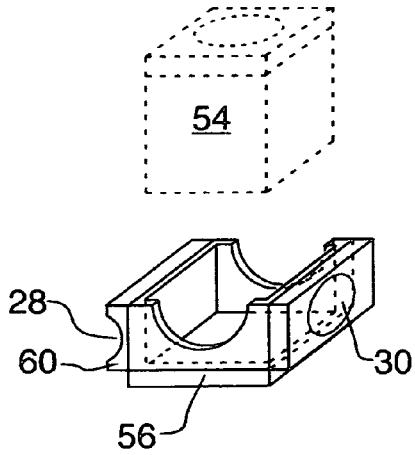
FIG. 4 is an perspective view of a chalk block holder for a conventional chalk cube having abrasive attachments thereon for abrading and shaping a pool cue tip.

FIG. 4 is an perspective view of a chalk block holder 24 for a conventional chalk cube 54 having abrasive attachments 60 thereon for abrading and shaping a pool cue tip (not shown). It is noted that FIG. 4 is used to show an alternative releasable attachment means 44 which comprises a magnet 56. As shown in FIG. 1 the block holder 24 can have an externally accessible opening 62 (or loop) carried thereby to receive a chain 64. The releasable attachment means 44, can be attached to either one of the block holder 24 or the belt clip 42. Most generally an apparatus 20 to chalk, abrade and shape a pool tip cue (not shown) comprises: a block holder 24 configured to receive the lower portion of a cube of chalk 54 of the type having a concave indentation 30 in an upper side portion thereof, said block holder 24 having an abrasive attachment 60 adhered to one side portion thereof. In the most preferred embodiment of this aspect of the invention two abrasive attachments 60 are provided, one having a concave valley 28 therein, and the other having a concave indentation 30 therein.

While the invention has been described with preferred specific embodiments thereof, it will be understood that this description is intended to illustrate and not to limit the scope of the invention, which is defined by the following claims.

I claim:

1. An apparatus for abrading and shaping a pool cue tip comprising:

i) a block having a top portion having a concave contour therein, said concave contour including an abrasive surface, said concave contour prevents said abrasive surface from shifting with respect to said block during use, and wherein said pool cue tip can be conveniently rounded when using said abrasive surface;

said concave contour further comprising a valley contoured on a single axis;

a side portion of said block adjacent to said top portion further comprising a concave indentation therein, and wherein said concave indentation is contoured on two axis; said block is formed continuously therethrough from an abrasive medium to provide dramatically extended and trouble-free service; and ii) a block holder positioned to closely surround a bottom portion of said block; wherein said block holder having an upper portion removed from an upright side portion thereof to accommodate access to said concave indentation in said block thereunder and therein.

2. The apparatus as in claim 1 further comprising means for chalking a cue tip, wherein another of said side portions of said block further comprising:

i) a void dimensioned to receive a chalk insert; and ii) a replaceable chalk insert dimensioned to be closely received, and positioned in the void.

3. The apparatus as in claim 2 wherein the chalk insert has an inner square portion to ensure the chalk insert does not rotate in the block during use.

4. The apparatus as in claim 2 wherein the chalk insert is glued in the void.

5. The apparatus as in claim 2 further comprising a chalk cover to cover the chalk insert in the block when the apparatus is not in use.

6. The apparatus as in claim 1 further comprising a belt clip and a releasable attachment means for releasably attaching the apparatus to the clip.

7. The apparatus as in claim 6 wherein the releasable attachment means comprises a peg having an outer diameter, said peg having one end attached to the block holder, and the other opposite end having a head of an enlarged diameter; and wherein an outside portion of the belt clip comprises an elongate vertical slot having sufficient width to receive the outside diameter of the peg, said vertical slot having a wider upper portion having sufficient width to receive the enlarged diameter of the head; so that when the peg's head is inserted through the wider upper portion and then lowered in the slot the apparatus is thereby releasably attached to the clip.

8. The apparatus as in claim 6 wherein the releasable attachment means comprises a magnet, attached to one of the block holder and the belt clip.

9. The apparatus as in claim 1 wherein the block holder is provided with an externally accessible opening to receive a chain.

* * * * *